US006302960B1

(12) United States Patent
Baroudi et al.

(10) Patent No.: US 6,302,960 B1
(45) Date of Patent: Oct. 16, 2001

(54) PHOTORESIST COATER

(75) Inventors: Walid Baroudi; David Saghafian, both of San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/199,947

(22) Filed: Nov. 23, 1998

(51) Int. Cl.[7] ..... B05C 11/02; B05B 13/04; B05B 1/00

(52) U.S. Cl. ..... 118/52; 118/320; 118/321; 118/663; 118/681; 134/153; 134/402; 239/596; 239/DIG. 19

(58) Field of Search ..... 118/52, 56, 223, 118/319, 320, 321, 323, 663, 681, 683, 684; 134/153, 902; 427/240; 901/43; 239/596, DIG. 9; 65/492, 374.13

(56) References Cited

U.S. PATENT DOCUMENTS

| | | | | |
|---|---|---|---|---|
| 4,244,521 | * | 1/1981 | Guse | 239/110 |
| 4,790,262 | | 12/1988 | Nakayama et al. | 118/52 |
| 5,033,681 | * | 7/1991 | Munoz | 239/596 |
| 5,063,874 | | 11/1991 | Dodds et al. | 118/602 |
| 5,094,884 | * | 3/1992 | Hillman et al. | 427/240 |
| 5,108,792 | | 4/1992 | Anderson et al. | 427/248.1 |
| 5,112,656 | * | 5/1992 | Nakamura et al. | 427/425 |
| 5,254,367 | | 10/1993 | Matsumura et al. | 427/240 |
| 5,362,372 | | 11/1994 | Tepman | 204/192.3 |
| 5,362,526 | | 11/1994 | Wang et al. | 427/573 |
| 5,380,414 | | 1/1995 | Tepman | 204/192.3 |
| 5,387,067 | | 2/1995 | Grunes | 414/217 |
| 5,392,989 | | 2/1995 | Hurtig | 239/119 |
| 5,427,820 | | 6/1995 | Biche et al. | 427/240 |
| 5,433,780 | | 7/1995 | Ikeda et al. | 118/50 |
| 5,454,871 | | 10/1995 | Liaw et al. | 118/300 |
| 5,472,502 | | 12/1995 | Batchelder | 118/52 |
| 5,486,975 | | 1/1996 | Shamouilian et al. | 361/234 |
| 5,695,658 | | 12/1997 | Alwan | 216/11 |
| 5,711,809 | | 1/1998 | Kimura et al. | 118/603 |
| 5,730,358 | * | 3/1998 | Raghavan et al. | 239/1 |
| 5,814,151 | | 9/1998 | Lee et al. | 118/300 |
| 5,820,038 | * | 10/1998 | Beltran et al. | 293/750 |
| 5,848,753 | * | 12/1998 | Wands et al. | 239/596 |
| 5,902,399 | * | 5/1999 | Courtenay | 118/52 |

FOREIGN PATENT DOCUMENTS

| | | |
|---|---|---|
| 379 339 A2 | 7/1990 | (EP) . |
| 0 540 447 A1 | 5/1993 | (EP) . |
| 618 504 A2 | 10/1994 | (EP) . |
| 0 810 478 A2 | 12/1997 | (EP) . |
| 2 597 372 | 10/1987 | (FR) . |
| 57166033 | 10/1982 | (JP) . |
| 62221464 | 9/1987 | (JP) . |
| 04035768 | 2/1992 | (JP) . |

OTHER PUBLICATIONS

Bureau et al., "Photoresist Deposition with Nitrogen to Supress the Dewetting Problem," IBM Technical disclosure bulletin, vol. 22, No. 5, Oct. 5, 1979, pg. 1884.

* cited by examiner

*Primary Examiner*—Richard Crispino
*Assistant Examiner*—J. A. Lorengo
(74) *Attorney, Agent, or Firm*—Robert Stern

(57) ABSTRACT

A photoresist coater has a rotatable chuck to support a substrate, a source of photoresist, a pivotable dispensing arm extendable over the chuck, and a nozzle at the end of the dispensing arm. The nozzle has an aperture with a dimension sufficiently small that photoresist directed therethrough forms an aerosol which is directed onto the substrate.

13 Claims, 3 Drawing Sheets

PHOTORESIST COATER

BACKGROUND

The present invention relates generally to integrated circuit fabrication, and more particularly to a coater for dispensing photoresist onto a substrate.

An initial step in the photolithographic fabrication of an integrated circuit is to coat a substrate, such as a silicon wafer, with a layer of photoresist. In one process, generally known as "spin-on" coating, the substrate is positioned on a rotating chuck and photoresist is dispensed onto the center of the substrate as it rotates. The centrifugal force generated by the rotation of the substrate urges the photoresist radially outward, in the process covering the substrate surface. Once the substrate has been coated, it may be removed from the coater and baked to cure the photoresist. Finally, the cured photoresist is exposed and chemically developed, and the substrate is etched to define circuitry features.

One problem encountered in photoresist coating is non-uniformity of the photoresist layer thickness. For example, during etching, the thicker portions of the photoresist layer may be underexposed whereas the thinner portions may be overexposed, resulting in defects and, thus, a decrease in process yield. One source of this non-uniformity is fluctuation in the droplet size and flow rate from the photoresist dispenser. Premature curing, in which the photoresist cures before it reaches the substrate edge, also produces a non-uniform surface.

Another problem is that some conventional photoresist coaters are inefficient and waste significant amounts of photoresist. As much as ninety-seven percent of the photoresist may be spun off the substrate surface during the coating process. There may also be additional costs in properly disposing of the photoresist if it is considered a hazardous waste.

SUMMARY

In general, in one aspect, the invention is directed to a photoresist coater. The photoresist coater has a rotatable chuck to support a substrate, a source of photoresist, a pivotable dispensing arm extendable over the chuck, and a nozzle at the end of the dispensing arm. The arm is movable between a first position in which an end of the arm is located substantially adjacent to a center portion of the substrate and a second position in which it is located substantially adjacent to an edge portion of the substrate. The nozzle is coupled to the photoresist source and has an aperture with a dimension sufficiently small that photoresist directed therethrough forms an aerosol which is directed onto the substrate.

Implementations of the invention may include one or more of the following. The aperture may be substantially circular and the dimension may be a diameter. The diameter of the aperture may be between about 100 and 300 microns. The nozzle may be part of a dispensing head located at the end of the dispensing arm. A flexible tube may extend between the photoresist source and the dispensing head to direct photoresist through the nozzle. The dispensing head may include a funnel-shaped section to direct photoresist from an end of the tube to the nozzle. The nozzle may include a generally cylindrically-shaped body with a passage therethrough and a nozzle head at an end of the passage. The aperture may extend through the nozzle head and may be in fluid communication with the passage through the generally cylindrically-shaped body. The generally cylindrically-shaped body may be made of metal and the nozzle head may be made of a crystalline material, such as ruby or sapphire.

A motor may be coupled to the dispensing arm to cause it to pivot, and a motor may rotate the chuck. The photoresist source may provide photoresist at a controllable flow rate and or a controllable pressure.

In another aspect the invention is directed to a nozzle for a photoresist coater. The nozzle has a nozzle body and a nozzle head. The nozzle body has a first fluid passage with a first cross-sectional dimension and an inlet side to receive photoresist. The nozzle head has a second fluid passage with a second cross-sectional dimension less than the first cross-sectional dimension, the second fluid passage coupled to an outlet of the first fluid passage. The second cross-sectional dimension is between about 100 and 300 microns.

In another aspect, the invention is directed to a dispensing head for dispensing photoresist onto a substrate. The head has a housing with a frustroconical-shaped first passage with an inlet side and an outlet side. The outlet side of the first passage has a first cross-sectional dimension. A nozzle is disposed downstream of the outlet side of the first passage. The nozzle includes a second passage which has a second cross-sectional dimension less than the first cross-sectional dimension, and a third passage having a third cross-sectional dimension less than the second cross-sectional dimension. The photoresist can be directed from the inlet side to the outlet side of the first passage, and through the second and third passages onto a substrate.

In another aspect, the invention is directed to a method of dispensing photoresist onto a substrate. The substrate is supported on a chuck. A dispensing arm is moved between a first position in which an end of the dispensing arm is located substantially adjacent a central portion of the substrate and a second position in which the end of the dispensing arm is located substantially adjacent an edge portion of the substrate. A photoresist fluid is directed through an aperture in a nozzle at the end of the dispensing arm. The aperture has a dimension sufficiently small that the photoresist forms an aerosol which is directed onto the substrate.

Advantages of the invention may include the following. The coater of the present invention dispenses a photoresist layer having a substantially uniform thickness, thereby decreasing fabrication defects and increasing process yield. The coater also uses less photoresist.

Other features and advantages of the invention will become apparent upon reading the following description, including the claims and drawings.

DETAILED DESCRIPTION

Figure 1:
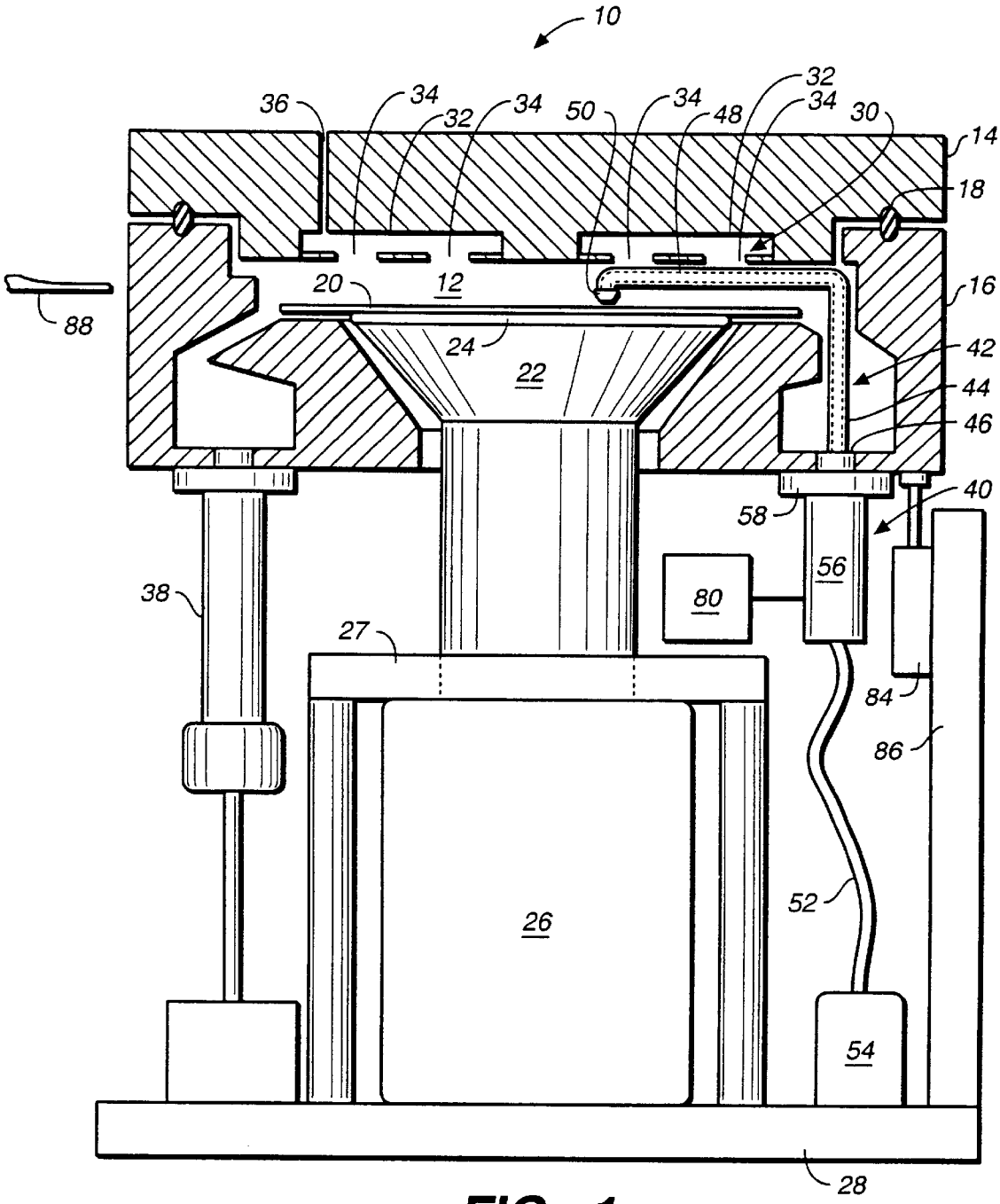
FIG. 1 is a schematic cross-sectional view of a photoresist coater according to the present invention.

Referring to FIG. 1, a photoresist coater 10 includes a controllable pressurized process chamber 12 formed by a housing having an upper section 14 and a lower section 16. A description of a similar coater may be found in U.S. application Ser. No. 08/651,277, filed May 22, 1996 by Homayoun Talieh, et al., entitled A COATER HAVING A CONTROLLABLE PRESSURIZED PROCESS CHAM- BER FOR SEMICONDUCTOR PROCESSING and assigned to the assignee of the present invention, the entire disclosure of which is incorporated herein by reference. Upper section 14 is sealed to lower housing section 16, e.g., by an O-ring 18. The sealed process chamber 12 provides a controlled environment for improved process uniformity.

A substrate 20, such as a silicon wafer, is supported in process chamber 12 on a chucking surface 24 of a wafer chuck 22. Wafer chuck 22 is coupled to a rotary motor 26 to rotate the substrate. Motor 26 may be secured to a base plate 28 by a bracket 27. Motor 26 may rotate substrate 20 at up to 10,000 revolutions per minute (rpm) during the spin-on coating step. The rpm setting will depend upon a variety of process parameters, such as the pressure in chamber 12 and the type of photoresist. A channel (not shown) may extend from chucking surface 24 through chuck 22 to a vacuum pump (not shown), and a negative pressure may be applied to the channel to secure the substrate to the chucking surface. Alternatively, at very low pressures, an electrostatic chuck may be used to secure the substrate to the chucking surface.

The vertical position of lower housing section 16 may be controlled by one or more air cylinders 84. Each air cylinder 84 can be secured to base plate 28 by a bracket 86.

To insert or remove a substrate from process chamber 12, air cylinder 84 lowers lower housing section 16 to permit access by a robot arm 88.

A shower-head assembly 30 is formed in upper housing section 14 for introducing a solvent vapor into process chamber 12. The shower head assembly may include a cavity 32 in upper housing section 14 and a plurality of uniformly spaced openings 34 between the cavity and the process chamber to introduce the solvent vapor into the process chamber. A passage 36 through the upper housing section may connect cavity 32 to a vapor delivery system (not shown), which includes a vaporizer and a pressure regulator, for generating a solvent vapor at a specified pressure. The solvent vapor introduced by the shower head assembly 32 into process chamber 12 may be evacuated by an exhaust system 38. By controlling the solvent vapor pressure with the vapor delivery system and the exhaust system, the rate of evaporation of solvent in the photoresist may be controlled, thereby controlling the rate of curing.

A uniform layer of photoresist is sprayed onto substrate 20 by a photoresist dispensing system 40. Photoresist dispensing system 40 includes a pivotable dispensing arm 42 having a generally vertical section 44 that extends through a sealed port 46 in lower housing section 16 and into process chamber 12, and a generally horizontal section 48 that extends over chuck 22 and substrate 20 (see also FIG. 2). A dispensing head 50 is located at the end of arm 42. The dispensing head 50 is equipped with a nozzle 68 (see FIG. 3) for directing a spray of photoresist onto the substrate. A flexible tube 52 (shown partially in phantom in FIG. 1) extends through dispensing arm 42 to connect dispensing head 50 to a photoresist source 54. Photoresist source 54 may be a photoresist container connected to a pump that provides photoresist at a controllable flow rate and pressure.

Figure 2:
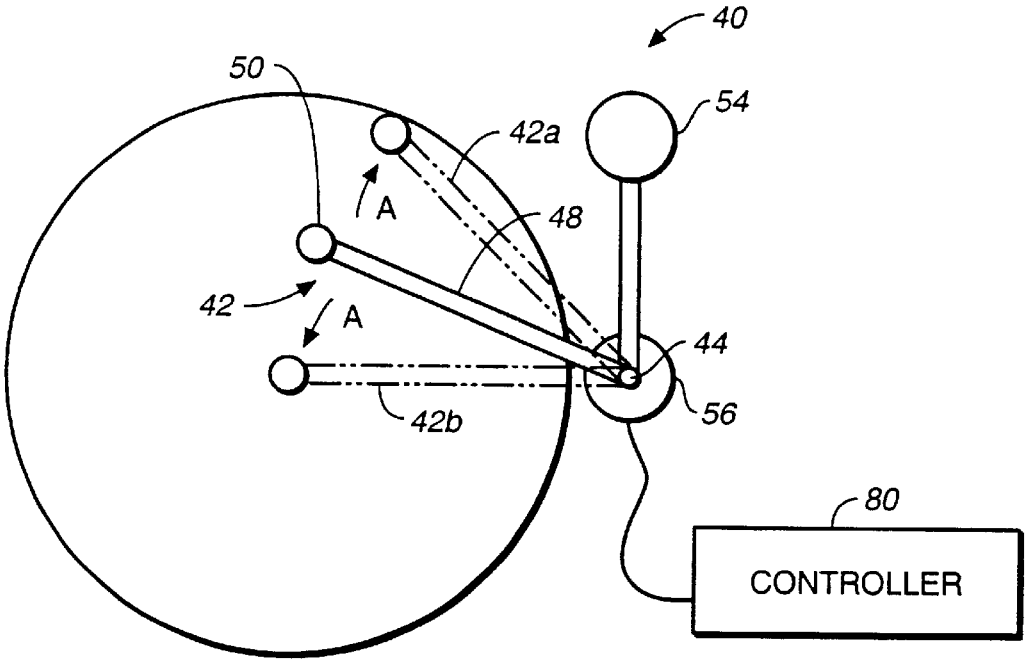
FIG. 2 is a schematic top view of a dispensing arm extending over a substrate.

Dispensing arm 42 is supported by a stepper motor 56 secured to lower housing 16 by a bracket 58. Referring to FIG. 2, stepper motor 56 is operated by a controller 80, such as a programmed general-purpose digital computer, to pivot the dispensing arm in the direction shown by arrows A between a first position (shown in phantom as 42*a*) in which dispensing head 50 is adjacent to an edge of substrate 20, and a second position (shown in phantom as 42*b*) in which dispensing head 50 is located more or less over the center of substrate 20. A photoresist fluid is directed from photoresist source 54 through tube 52 and nozzle 68 at a controlled, constant pressure to form a spray or aerosol of photoresist that impinges on the exposed surface of substrate 20.

Figure 3:
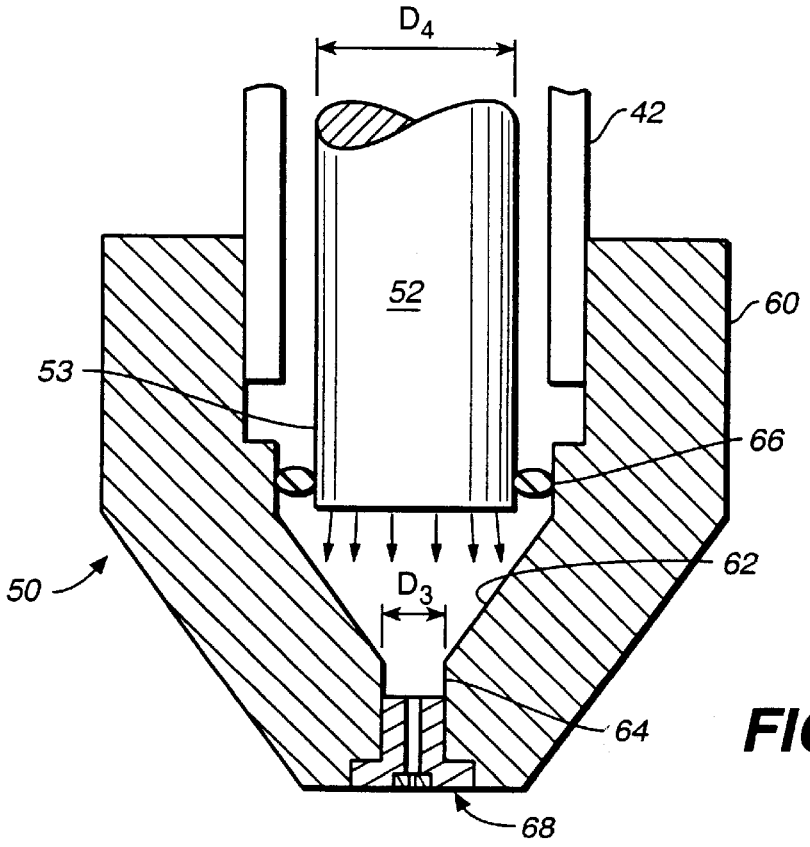
FIG. 3 is a cross-sectional view of a photoresist dispensing head of the coater of FIG. 1.

Referring to FIG. 3, dispensing head 50 includes a housing assembly 60 at the end of dispensing arm 42. The interior surface of housing assembly 60 includes a funnel-shaped (frustroconical) section 62 which leads to an exit passage 64 in which nozzle 68 is located. The distal end portion 53 of tube 52 may be sealed to housing 60, e.g., by an O-ring 66. As noted, the proximal end portion of tube 52 is connected to photoresist source 54.

Figure 4:
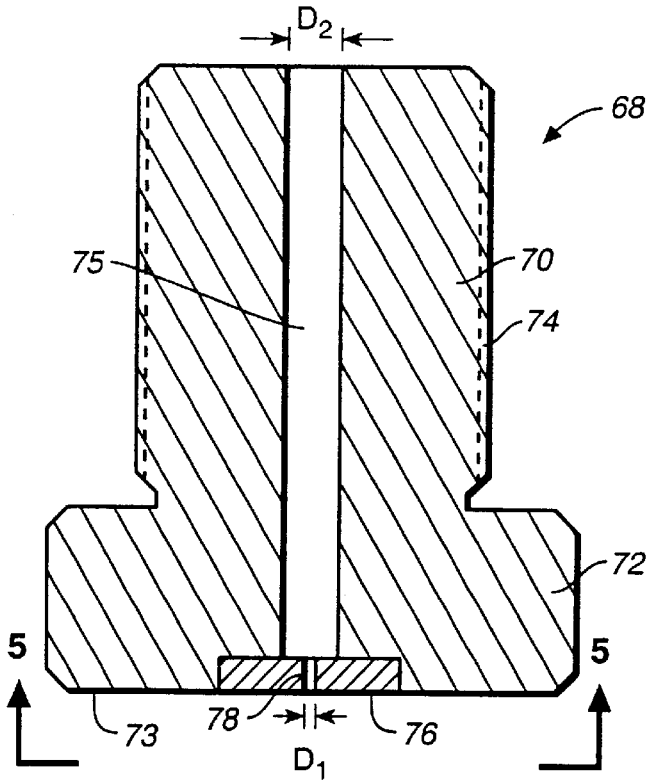
FIG. 4 is an enlarged view of the dispensing head of FIG. 3.
Figure 5:
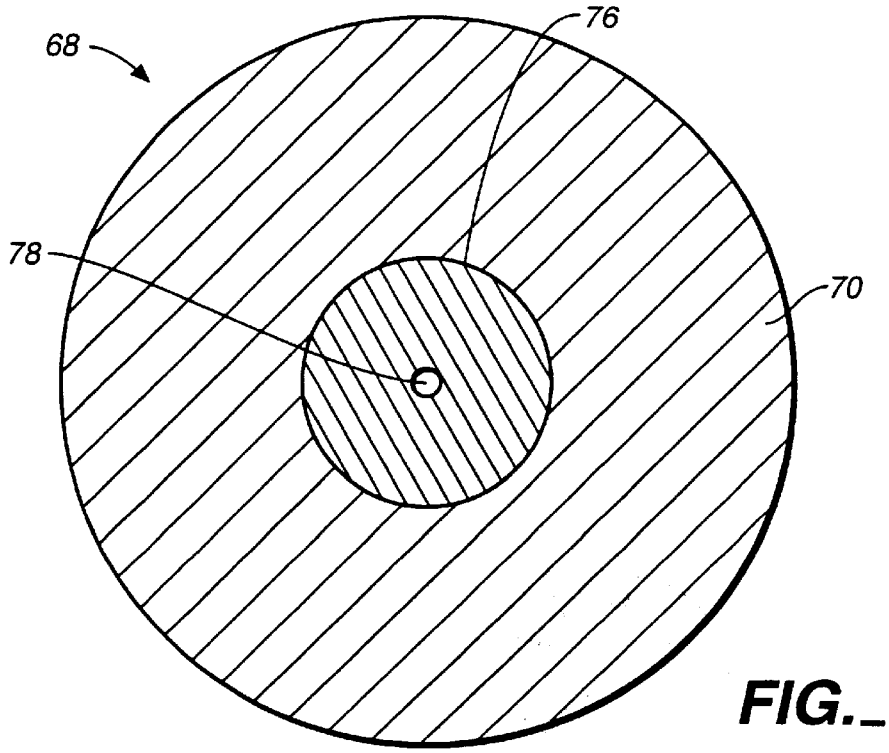
FIG. 5 is a bottom view taken along line 5—5 of FIG. 4.

Referring to FIGS. 4 and 5, nozzle 68 comprises a generally cylindrical body 70 and an annular flange portion 72. The passage 64 of housing assembly 60 is threaded, and the outer surface 74 of cylindrical body 70 is likewise threaded so that the nozzle may be screwed into passage 64 (see FIG. 3). Alternately, nozzle 68 could be snap-fit in passage 64 or formed as an integral part of housing assembly 60. An annular nozzle head 76 having a circular aperture 78 is provided at the tip of the nozzle, e.g., flush with the lower surface of flange portion 72. A passage 75 extends through the cylindrical body 70 of the nozzle to provide fluid communication between funnel-shaped section 62 and aperture 78. The aperture 78 may have a diameter, $D_1$, of about 100–300 microns, whereas passage 75 may have a diameter, $D_2$, of about 1/16 inch, passage 64 may have a diameter, $D_3$, of about 1/8 inch, and tube 52 may have a diameter, $D_4$, of about 1/4 inch. The exact diameter of nozzle aperture 78 will depend upon the viscosity of the photoresist and the pressure in chamber 12, and is selected to be sufficiently small that the photoresist is forced through the aperture at a pressure of about 10–15 psi so that the photoresist exits the aperture at a relatively high velocity and forms an aerosol or fine spray. The nozzle is oriented to directed the photoresist aerosol onto the substrate to create a layer of substantially uniform thickness. The droplet size in the photoresist aerosol may be approximately the same as the aperture diameter, i.e., about 100 to 300 microns.

The cylindrical body 70 may be formed of a corrosion-resistant metal, such as brass, whereas nozzle head 76 may be formed of a material with a non-adhesive surface, particularly a crystalline material such as ruby or sapphire. The non-adhesive surface of the crystalline nozzle head minimizes the surface tension so as to prevent the formation of large fluid droplets in the photoresist spray.

Referring to FIGS. 1 and 2, in operation, motor 26 rotates substrate 20 as photoresist source 54 pumps photoresist through nozzle 68 (see FIG. 3). As the substrate rotates, stepper motor 56 pivots dispensing arm 42 from the edge to the center of substrate 20 so that the substrate surface is sprayed with photoresist. The rate of motion of dispensing arm 42 need not be uniform. Since the outer portion of the substrate has a larger surface area than its central portion, the controller 80 may be programmed to position the dispensing head with a longer dwell time over the outer portions of the substrate. This ensures a uniform distribution of photoresist onto the surface of the substrate, providing a photoresist layer with a uniform thickness. In addition, since the photoresist flowing through nozzle 68 can be dispensed to desired locations on the substrate in limited amounts, the photoresist is used more efficiently.

Alternate structures are possible for the photoresist coater. For example, the passages in the nozzle head, nozzle, and dispensing head could have a rectangular, oval, or other cross-sectional area, and be characterized by some dimension other than a diameter.

The invention is not limited by the embodiment depicted and described. Rather, the scope of the invention is defined by the appended claims.

What is claimed is:

1. A photoresist coater, comprising:

a rotatable chuck to support a substrate;

a source of photoresist;

a pivotable dispensing arm extendable over the chuck and movable between a first position in which an end of the dispensing arm is located substantially adjacent a center portion of the substrate and a second position in which the end of dispensing arm is located substantially adjacent an edge portion of the substrate; and a dispensing head at the end of the dispensing arm and coupled to the photoresist source, the dispensing head including an outlet passageway, a nozzle located in the outlet passageway, the nozzle including a nozzle body having a passage therethrough and a nozzle head located at the end of the nozzle body passage, the nozzle head having a substantially circular aperture between about 100 and 300 microns in diameter such that photoresist directed therethrough is directed onto the substrate.

2. The coater of claim 1, wherein the nozzle is part of a dispensing head located at the end of the dispensing arm.

3. The coater of claim 1, further comprising a flexible tube extending between the photoresist source and the dispensing head to direct photoresist through the nozzle.

4. The coater of claim 3, wherein the dispensing head includes a funnel-shaped section to direct photoresist from an end of the tube to the nozzle.

5. The coater of claim 1, wherein the nozzle includes a generally cylindrically-shaped body having a passage therethrough, and a nozzle head at an end of the passage, the aperture extending through the nozzle head and in fluid communication with the passage through the generally cylindrically-shaped body.

6. The coater of claim 1, wherein the nozzle body is made of metal.

7. The coater of claim 6, wherein the nozzle head is made of a crystalline material.

8. The coater of claim 7, wherein the crystalline material is selected from the group consisting of ruby and sapphire.

9. The coater of claim 1, further comprising a motor coupled to the dispensing arm to cause it to pivot.

10. The coater of claim 1, further comprising a motor to rotate the chuck.

11. The coater of claim 1, wherein the photoresist source provides photoresist at a controllable flow rate.

12. The coater of claim 1, wherein the photoresist source provides photoresist at a controllable pressure.

13. A coater for dispensing photoresist onto a substrate, comprising:

a rotatable chuck to support the substrate;

a first motor to rotate the chuck;

a source of photoresist;

a pivotable dispensing arm extendable over the chuck and movable between a first position in which an end of the dispensing arm is located substantially adjacent a central portion of the substrate and a second position in which the end of the dispensing arm is located substantially adjacent an edge portion of the substrate;

a second motor coupled to the dispensing arm to cause it to pivot;

a dispensing head at the end of the dispensing arm, the dispensing head including an outlet passageway, a nozzle located in the outlet passageway, the nozzle having a nozzle body having a passage therethrough and a nozzle head made of a crystalline material located at the end of the nozzle body passage and having an aperture in fluid communication with the nozzle body passage, the aperture having a cross-sectional dimension such that photoresist directed therethrough is directed onto the substrate; and a flexible tube extending from the photoresist source through the dispensing arm and to the dispensing head to direct photoresist through the nozzle.

* * * * *